US008806702B2

(12) United States Patent
Wolfe, Jr. et al.

(10) Patent No.: US 8,806,702 B2
(45) Date of Patent: Aug. 19, 2014

(54) PORTABLE VACUUM CLEANER

(75) Inventors: Melvin E. Wolfe, Jr., Johnson City, NY (US); Scott G. Smith, Muncy, PA (US)

(73) Assignee: Shop Vac Corporation, Williamsport, PA (US)

( * ) Notice: Subject to any disclaimer, the term of this patent is extended or adjusted under 35 U.S.C. 154(b) by 193 days.

(21) Appl. No.: 13/436,023

(22) Filed: Mar. 30, 2012

(65) Prior Publication Data

US 2013/0255029 A1 Oct. 3, 2013

(51) Int. Cl.
*A47L 9/22* (2006.01)
*A47L 11/40* (2006.01)

(52) U.S. Cl.
USPC ..... 15/319; 15/DIG. 1

(58) Field of Classification Search
CPC ..... A47L 9/009; A47L 9/28; A47L 5/24; A47L 1/40; Y10S 15/01
USPC ..... 15/319, 339, 344, 412, DIG. 1
See application file for complete search history.

(56) References Cited

U.S. PATENT DOCUMENTS 4,835,409 A 5/1989 Bhagwat et al.
5,510,691 A 4/1996 Palatov
5,516,189 A 5/1996 Ligeras
5,715,156 A * 2/1998 Yilmaz et al. ..... 363/142
5,751,564 A 5/1998 Dien
5,766,020 A 6/1998 Hughes
5,901,056 A * 5/1999 Hung ..... 363/142
6,104,162 A * 8/2000 Sainsbury et al. ..... 320/111
6,448,732 B1 9/2002 Block
6,493,903 B1 12/2002 Super
6,495,932 B1 * 12/2002 Yoshimizu et al. ..... 307/150
6,751,109 B2 6/2004 Doss et al.
6,966,669 B2 11/2005 Hussaini et al.
6,971,951 B2 12/2005 Boyer
7,002,265 B2 2/2006 Potega
7,142,103 B2 11/2006 Chen et al.
7,193,873 B2 3/2007 Lanni
7,224,086 B2 5/2007 Germagian et al.
7,453,171 B2 11/2008 Lanni
7,764,050 B2 7/2010 Xing et al.
7,868,486 B2 1/2011 Lanni
7,884,560 B2 2/2011 Lucas et al.
7,893,558 B2 2/2011 Lee
7,989,981 B2 8/2011 Zhang
7,999,412 B2 8/2011 Lanni
8,076,873 B1 12/2011 Lucas et al.
8,365,350 B2 * 2/2013 Cochran et al. ..... 15/327.2
8,590,103 B2 * 11/2013 Wolfe, Jr. ..... 15/412
2002/0121000 A1 9/2002 Tyler
2005/0273969 A1 12/2005 Watson et al.
2007/0025128 A1 2/2007 Cha
2008/0052544 A1 2/2008 Hsieh et al.
2008/0197716 A1 8/2008 Rubio et al.
2008/0284363 A1 11/2008 Lucas et al.
2009/0027013 A1 1/2009 Odaohhara
2010/0005614 A1 1/2010 Cochran et al.
2010/0039792 A1 2/2010 Meyers et al.

(Continued)

*Primary Examiner* — Dung Van Nguyen
(74) *Attorney, Agent, or Firm* — Marshall, Gerstein & Borun LLP; Randall G. Rueth

(57) ABSTRACT

A portable vacuum cleaner is disclosed. The portable vacuum cleaner includes a rechargeable battery and a DC motor. The portable vacuum cleaner further includes a DC power input port for receiving DC power from a remote power source. The DC motor is operable in response to power from either the battery or the remote power source.

15 Claims, 9 Drawing Sheets

(56) References Cited

U.S. PATENT DOCUMENTS

| | | | |
|---|---|---|---|
| 2010/0083457 | A1 | 4/2010 | Norell et al. |
| 2010/0321939 | A1 | 12/2010 | Patel |
| 2011/0239398 | A1 | 10/2011 | Furusawa et al. |
| 2011/0266874 | A1 | 11/2011 | Soemantri et al. |
| 2011/0298306 | A1 | 12/2011 | Lanni |

* cited by examiner

PORTABLE VACUUM CLEANER

BACKGROUND OF THE INVENTION

The present application relates to portable vacuum cleaners which may be powered by a rechargeable battery or which may be powered via a conventional source of external DC power, such as vehicle's 12v DC power supply.

BRIEF SUMMARY

In accordance with the disclosure, a portable vacuum cleaner is provided. The portable vacuum cleaner may comprise a rechargeable battery having a nominal battery voltage output at a first voltage level and a DC motor operable at a voltage level substantially equal to the first voltage level. The portable vacuum cleaner may further comprises a DC power input port for receiving DC power. The DC power input port may be adapted to electrically couple the vacuum cleaner alternatively to a first source of DC power at a first voltage output level substantially equal to the first voltage level and a second source of DC power at a second voltage output level, the second voltage level substantially greater than the first voltage level.

The first source of DC power may be a DC adapter, such as one configured to plug into a conventional power, or cigarette, outlet of a vehicle. The second source of DC power may be an AC/DC converter, such as one configured to plug into a conventional AC power outlet.

The vacuum cleaner may still further comprise a switching device, such as a two position power switch cooperating with a two position car/battery charge switch. The switching device may have four output states switchable to selectively cause four operational states. The operational states comprising a first operational state wherein the motor will operate as powered by the battery, a second operational state wherein the motor will not operate, and the battery will not charge if coupled to the first source of DC power and the battery will charge if coupled to the second source of DC power, a third operational state wherein the motor will operate if coupled to the first source of DC power but will not operate if coupled to the second source of DC power and a fourth operational state wherein the motor will not operate and the battery will not recharge.

It is contemplated that nominal voltage of the battery and the motor may be 12v DC.

It is further contemplated that the AC/DC converter may provide an output voltage in the range of 14.5-14.8v DC and a trickle charge of approximately 300 mA.

Other features and advantages of the invention will be apparent from the following specification taken in conjunction with the following drawings.

DETAILED DESCRIPTION OF THE INVENTION

Figure 1:
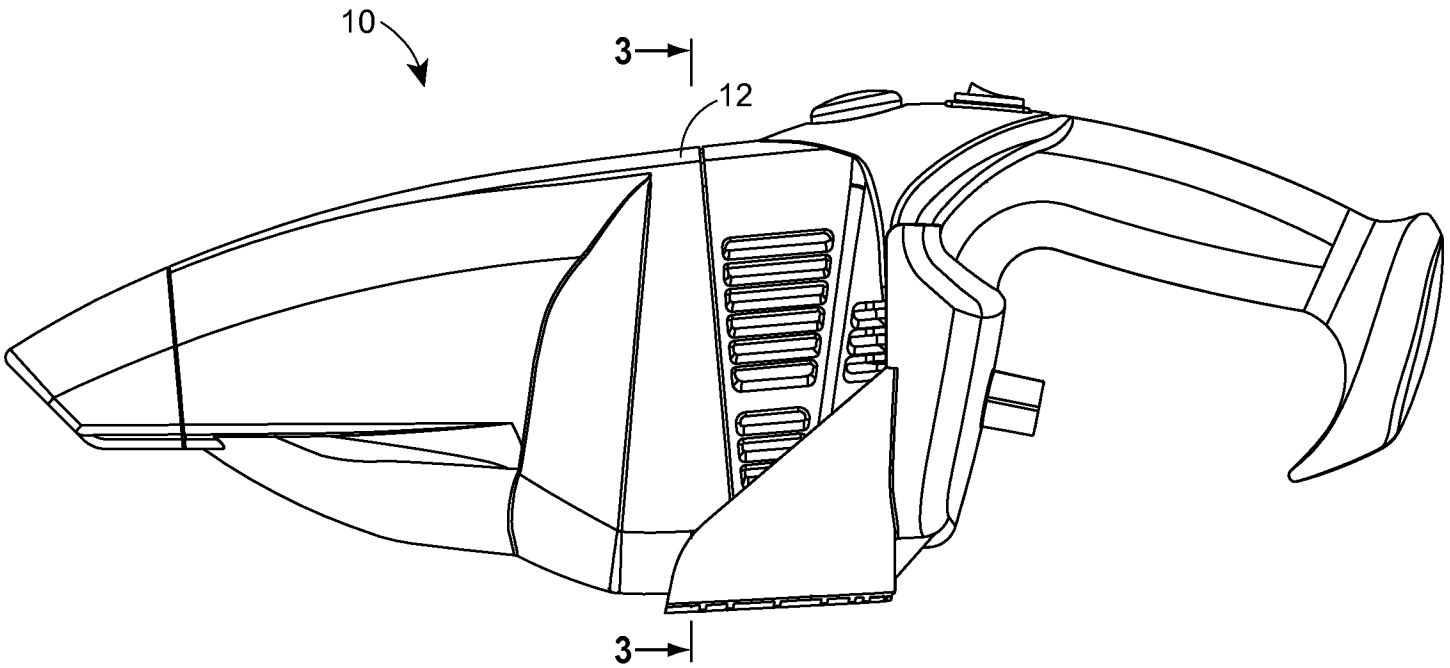
FIG. 1 is a side view of a first embodiment of a battery powered vacuum cleaner in accordance with the present invention.

While this invention is susceptible of embodiments in many different forms, there is shown in the drawings and will herein be described in detail, preferred embodiments of the invention with the understanding that the present disclosure is to be considered as an exemplification of the principles of the invention and is not intended to limit the broad aspect of the invention to the embodiments illustrated.

Figure 2:
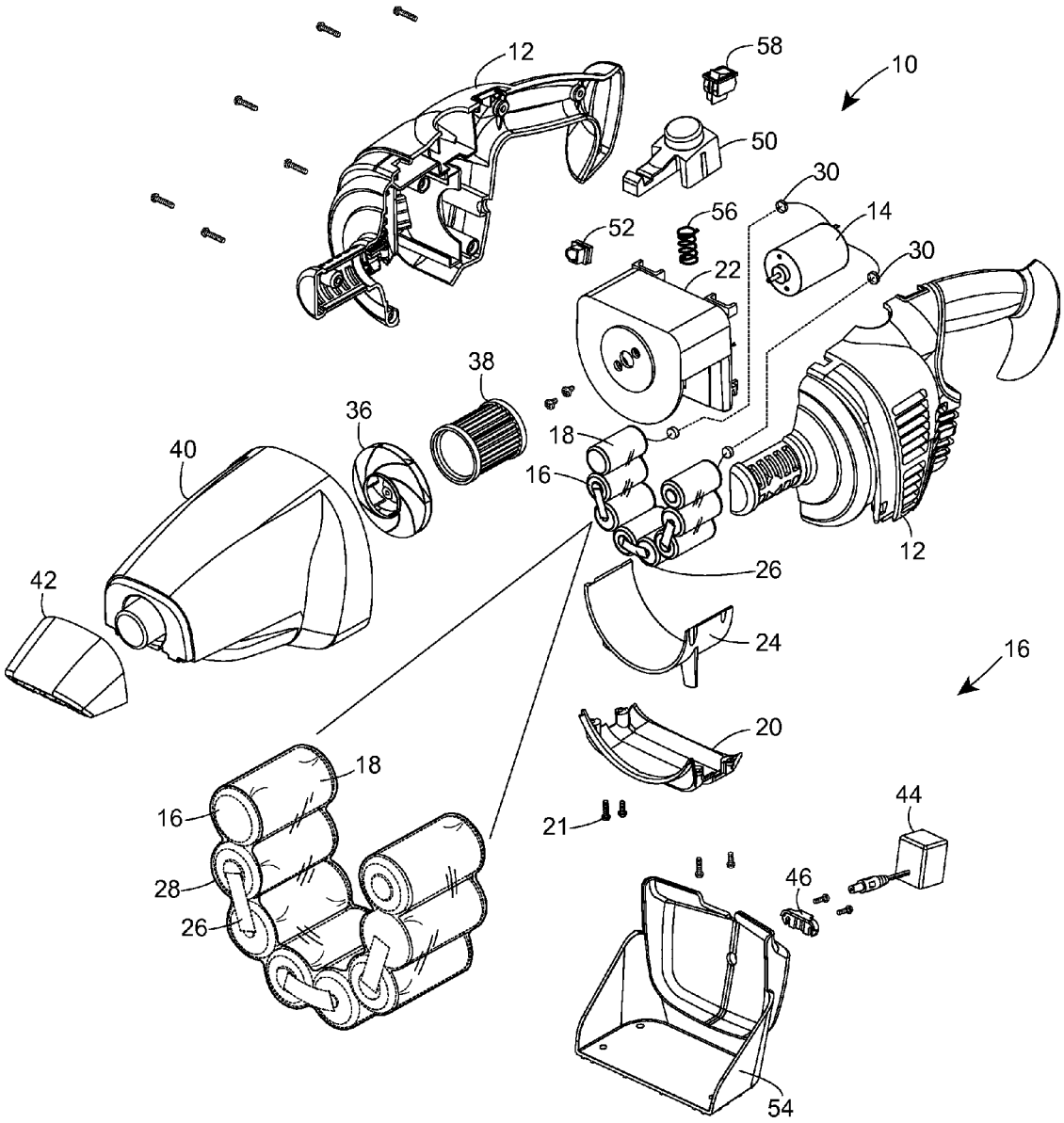
FIG. 2 is an exploded view of the vacuum cleaner of FIG. 1.
Figure 3:
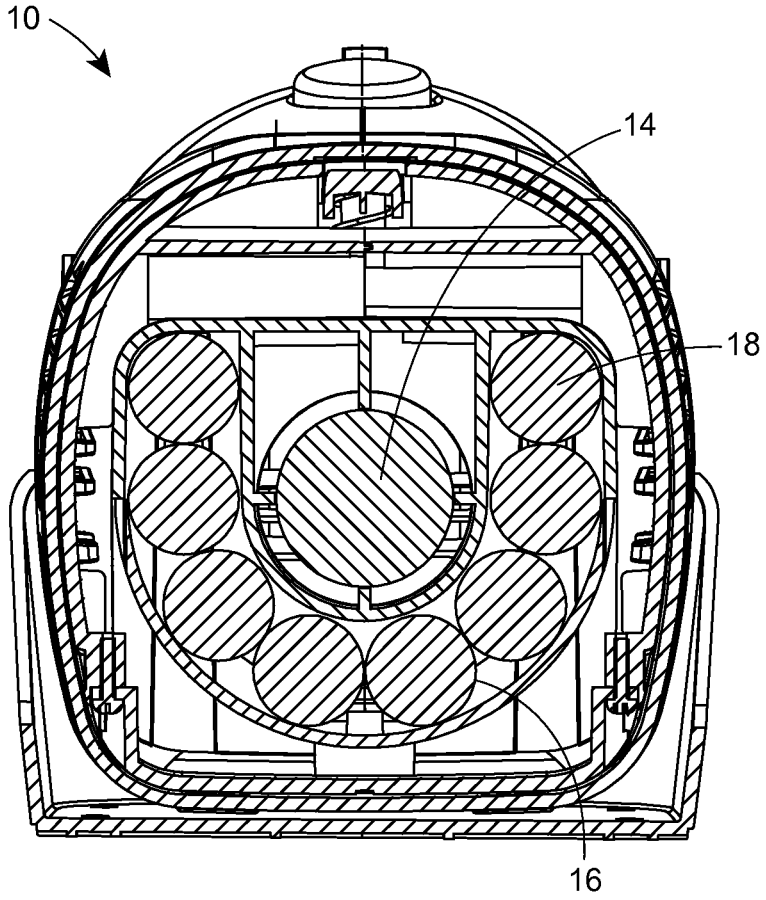
FIG. 3 is a sectional view of the vacuum cleaner of FIG. 1, taken along line 3-3 of FIG. 1.

A first embodiment of a battery powered vacuum cleaner, generally designated 10, is illustrated in FIGS. 1-3. The vacuum cleaner 10 may be a hand held portable vacuum cleaner.

The vacuum cleaner 10 may comprise a two-piece vacuum cleaner housing 12, a motor 14, such as a conventional 9.8v. motor, disposed within the housing 12, and a battery, such as a battery pack 16 comprising eight rechargeable battery cells 18 arranged in a generally horseshoe configuration. The motor 14 has an axis of rotation, and the battery cells 18 are arranged substantially coaxial with the axis of rotation of the motor 14. The actual number of battery cells, and thus the overall voltage of the battery pack 16, may vary, depending upon the voltage required by the particular motor.

The battery pack 16 may be wrapped about the motor 14 within the vacuum cleaner housing 12. The battery pack 16 may directly engage the motor 14. The vacuum cleaner 10 may further include a removable battery door 20, secured to the housing 12, such as by conventional screws 21. The battery door 20 may provide access to the battery pack 16 and may be adapted to permit relatively easy removal of the battery pack 16 from the vacuum cleaner housing 12. Permitting removal of the battery pack 16 permits one to remove the battery pack 16, such as to permit replacement of the battery pack 16 or to permit environmentally friendly disposal of the battery pack 16 separate from disposal of the vacuum cleaner 10 itself. The motor 14 and battery pack 16 may also be contained within a motor housing 22 and battery cover 24, which may be collectively contained within the vacuum cleaner housing 12.

The battery pack 16 may include conductive tabs 26 electrically coupling the battery cells 18 in series. The conductive tabs 26 may structurally interconnect the battery cells 18. The battery cells 18 of the battery pack 16 may also be flexibly enclosed in a unitary shrink-wrap covering 28. The battery pack 16 may be electrically coupled to the motor 14 by separable connectors 30, to permit easy separation/reattachment of the battery pack 16 from/to the motor 14.

The vacuum cleaner 10 may also include conventional vacuum cleaner components, including an impeller 36 driven by the motor 14, a filter cartridge 38, a dust housing 40 and a snout 42. The vacuum cleaner may further include a charger 44, a jacket 46, a latch 50, a recharge socket 52, a wall mounting bracket 54, a spring 56 and a motor actuating switch 58.

The charger 44 may have a charger cable 44*a* for insertion into a DC power input port 52. The charger 44 may be an AC/DC converter.

Figure 4:
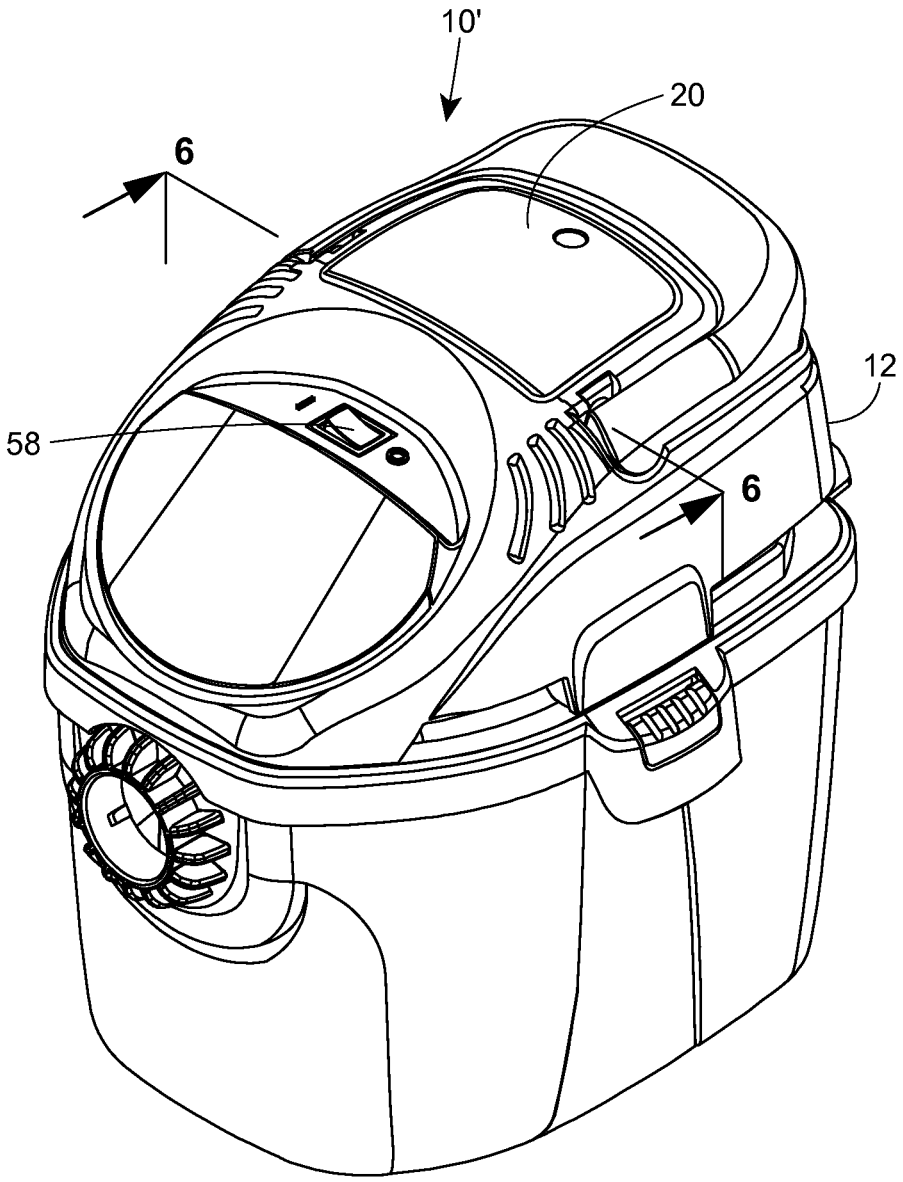
FIG. 4 is a perspective view of a second embodiment of a battery powered vacuum cleaner in accordance with the present invention.
Figure 5:
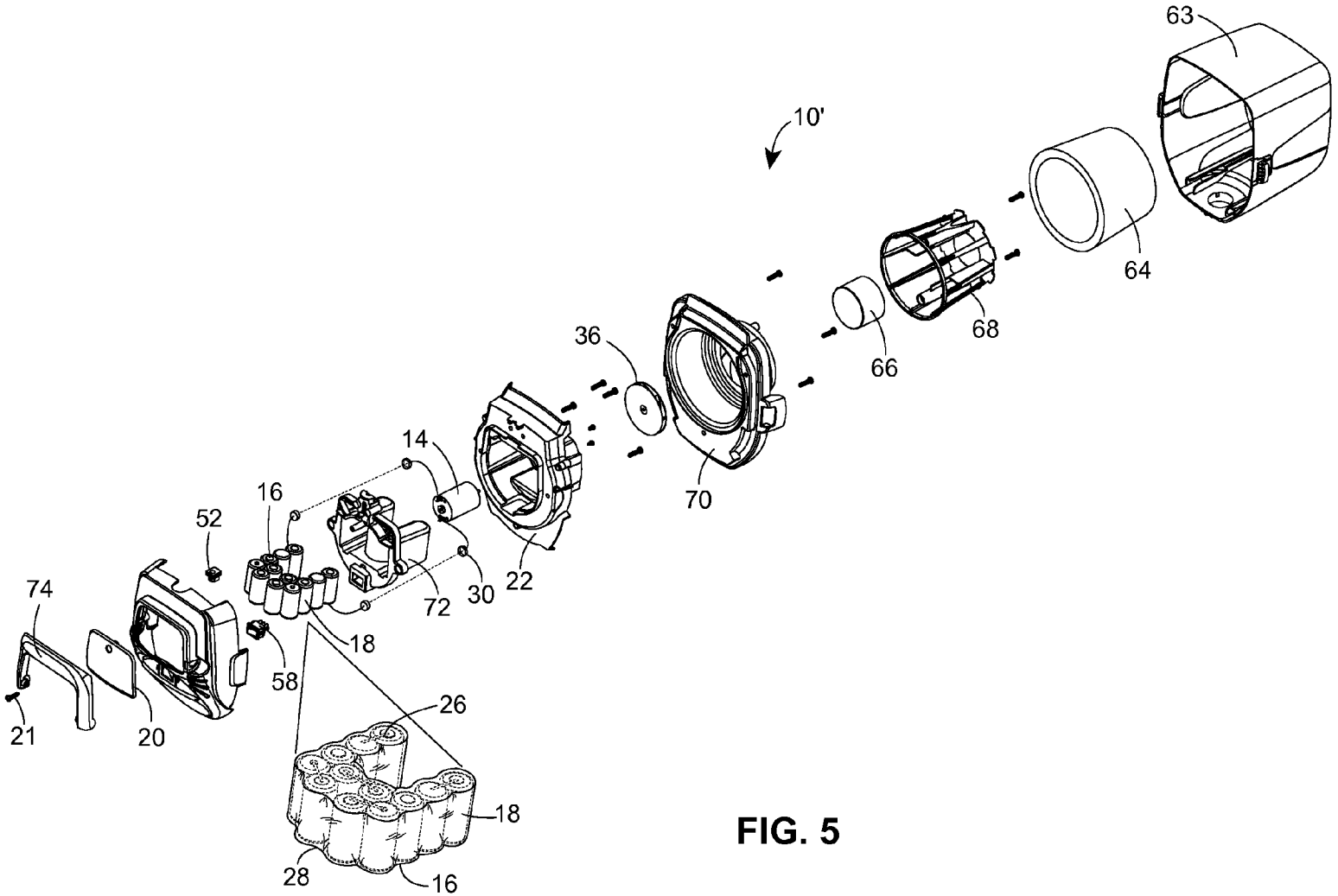
FIG. 5 is an exploded view of the vacuum cleaner of FIG. 4.
Figure 6:
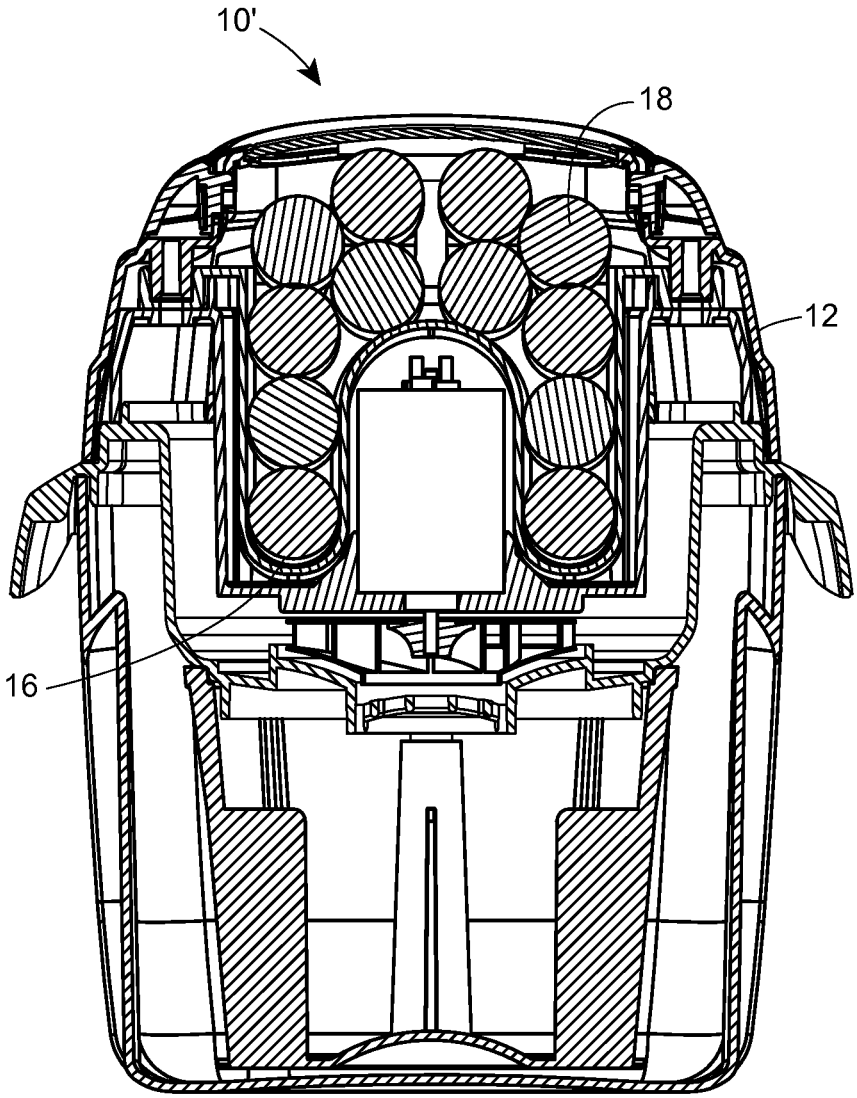
FIG. 6 is a sectional view of the vacuum cleaner of FIG. 4, taken along line 6-6 of FIG. 4.

A second embodiment of a battery powered vacuum cleaner 10' is illustrated in FIGS. 4-6. The vacuum cleaner 10' may be what is commonly referred to as a wet/dry vacuum cleaner. Components of the vacuum cleaner 10' which are functionally similar to the components of the first embodiment of the vacuum cleaner 10 are indentified with the same reference numbers.

The vacuum cleaner 10' may comprise a vacuum cleaner housing 12, a motor 14, such as a conventional 9.8v. motor, disposed within the housing 12 and a battery pack 16 comprising twelve rechargeable battery cells 18 arranged in a generally horseshoe configuration. The actual number of the battery cells 18, and thus the overall voltage of the battery pack 16, may vary, depending upon the voltage required by the particular motor.

The battery pack 16 may be wrapped about the motor 14 within the vacuum cleaner housing 12. The battery pack 16 may directly engage the motor 14. The motor 14 has an axis of rotation, and the battery cells 18 are arranged substantially perpendicular to the axis of rotation of the motor 14. The vacuum cleaner 10 may further include a removable battery door 20, secured to the housing 12 such as by a conventional screw 21. The battery door 20 may provide access to the battery pack 16 and may be adapted to permit relatively easy removal of the battery pack 16 from the vacuum cleaner housing 12. As with the first embodiment, permitting removal of the battery pack 16 permits one to remove the battery pack 16, such as to permit replacement of the battery pack 16 or to permit environmentally friendly disposal of the battery pack 16 separate from disposal of the vacuum cleaner 10' itself. The motor 14 and battery pack 16 may also be contained within a motor housing 22 which may be contained within the vacuum cleaner housing 12.

The battery pack 16 may include conductive tabs 26 electrically coupling the battery cells 18 in series. The conductive tabs 26 may structurally interconnect the battery cells 18. The battery cells 18 of the battery pack 16 may also be flexibly enclosed in a unitary shrink-wrap covering 28. The battery pack 16 may be electrically coupled to the motor 14 by separable connectors 30, to permit easy separation/reattachment of the battery pack 16 from/to the motor 14.

The vacuum cleaner 10' may also include conventional vacuum cleaner components, including an impeller 36 driven by the motor 14 and a conventional filter cartridge (not shown). The vacuum cleaner may further include a conventional charger (not shown), a conventional recharge socket 52, and a motor actuating switch 58.

The vacuum cleaner 10' may further include a tank 63, a foam sleeve 64, a float cup 66 and a cage 68 disposed between the foam sleeve 64 and the float cup 66. The vacuum cleaner 10' may still further include a lid 70, a baffle 72 and a handle 74.

A modified version of the vacuum cleaner, discussed above and hereinafter referred to as the modified vacuum cleaner 10", is illustrated in FIGS. 7*a*-7*d* and FIG. 8. The modified vacuum cleaner 10" may be powered by a rechargeable DC battery pack 16", such as a 12v DC battery pack.

The battery pack 16" may be recharged by an AC/DC charger 44", having an AC/DC charger cable 44*a*. The AC/DC charger 44" may convert AC power, such as conventional 110-120v AC, to DC power, such as 14.5-14.8v DC, at 300 mA. The charger 44" may provide the DC power, such as the 14.5-14.8v DC power at 300 mA, until the voltage across the battery pack 16" reaches the output voltage of the AC/DC charger 44, at which time the charger 44" may shut off, until such time as the voltage across the battery pack 16 dissipates below this amount.

Alternatively the modified vacuum cleaner 10" may be powered by a DC power adapter 80, such as power adapter providing a 12v DC power output, having an output power adapter cable 80*a*. The power adapter 80 may be adapted to be plugged in to a conventional DC power supply, such as a conventional 12v DC cigarette lighter (not shown) of a vehicle, to provide a 12 DC voltage to the modified vacuum cleaner 10".

Referring in particular to FIGS. 7*a*-7*d* and 8, the modified vacuum cleaner 10" may include a DC motor 14", such as a 12v DC motor, having a positive motor terminal 14*a* and a negative motor terminal 14*b*. The modified vacuum cleaner 10" may further include a rechargeable DC battery pack 16", such as a 12v DC battery pack, having a positive battery terminal 16*a* and a negative battery terminal 16*b*. The modified vacuum cleaner 10" may still further include the two position power switch 58 having a common power switch terminal 58*a* selectively coupled to a first power switch terminal 58*b* and to a second power switch terminal 58*c*. When the common power switch terminal 58*a* is coupled to the first power switch terminal 58*b*, the power switch 58 is in the "off" position and when the common power switch terminal 58*a* is coupled to the second power switch terminal 58*c*, the power switch 58 is in the "on" position.

The modified vacuum cleaner 10" may further include a two position car/charge switch 82 having a common car/charge switch terminal 82*a* selectively coupled to a first car/charge switch terminal 82*b* and a second car/charge switch terminal 82*c*. When the common car/charger switch terminal 82*a* is coupled to the first car/charge switch terminal 82*b*, the car/charge switch is in "car" position and when the common car/charge switch terminal 82*a* is coupled to the second car/charge switch terminal 82*c*, the car/charge switch 82 is in the "battery/charge" position.

The present disclosure describes two, two-position switches, 58, 82, which collectively provide four output states. It is to be understood that the switches 58, 82 may be in the form of a single switching device that selectively provides at least four output states.

The modified vacuum cleaner 10" may still further include a DC power input port 52' having a positive input terminal 52*a*' and a negative input terminal 52*b*'. The DC power input port 52' may be adapted to alternatively receive the AC/DC power cable 44*a* or the DC power cable 80*a*.

The modified vacuum cleaner 10" may further include a circuit, generally designated 84, for selectively coupling power received from the DC power input port 52' to the motor 14" and the battery pack 16".

The power switch 58 and the charging switch 82 may selectively provide four current paths 84*a*-84*d*. These four paths are illustrated, in bold, in FIGS. 7*a*-7*b*, respectively.

Figure 7A:
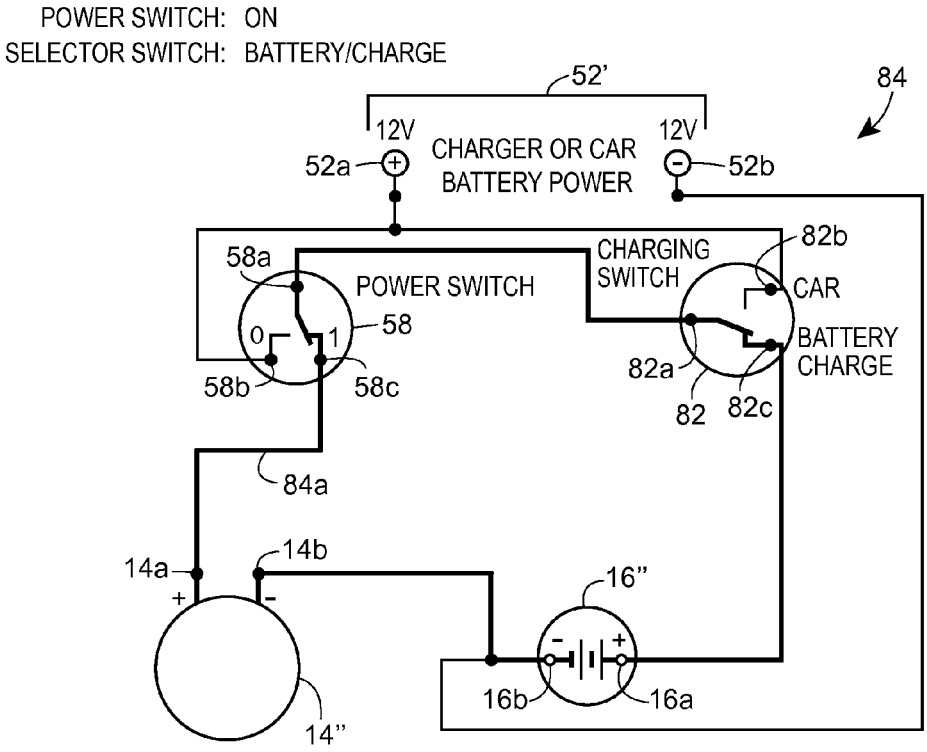
FIGS. 7*a*-7*d* are schematic views of wiring of a modified version of the battery powered vacuum cleaner of FIG. 4, in accordance with the present invention, each of the FIGS. 7*a*-7*b* illustrating particular current paths.

The first current path 84*a* is illustrated in bold in FIG. 7*a*. This occurs when the power switch 58 is in the "on" position and the charge switch 82 is in the "battery/charge" position. In this situation, the motor 14" will operate, powered by the battery pack 16".

Figure 7B:
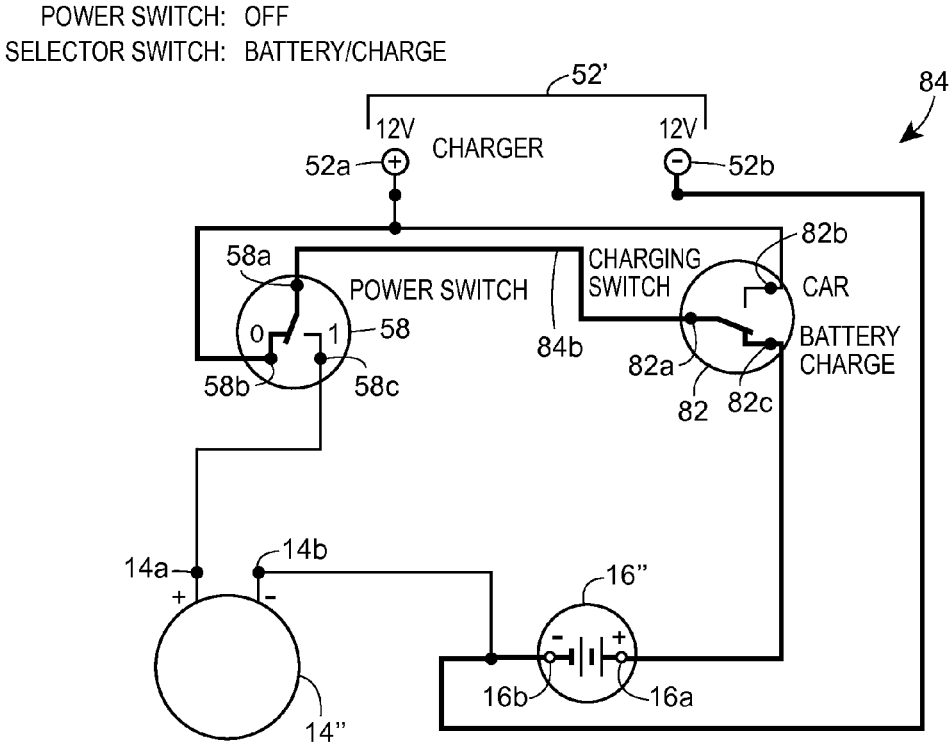

The second current path 84*b* is illustrated in bold in FIG. 7*b*. This occurs when the power switch 58 is in the "off" position and the charge switch 82 is in the "battery/charge" position. In this situation, the motor 14" will not operate. If the AC/DC charger 44 is plugged into the DC power input port 52*a*, a DC potential may be applied across the battery pack 16", thereby charging the battery pack 16", until the voltage across the battery pack 16" reaches the DC output voltage of the AC/DC charger 44", such as 14.5-14.8v DC.

If the 12v DC power adapter 80 is plugged into the DC power input port 52*a*, a potential of 12v DC may be applied across the battery pack 16". However the nominal voltage of the battery pack 16", even when discharged, does not drop below its nominal output voltage, such as 12v DC. Therefore the 12v DC power adapter 80 will not charge the battery pack 16" when the 12v DC power adapter 80 is plugged into the DC power input port 52*a*. This prevents depleting the source of the 12v DC power, such as the vehicle's car battery.

Figure 7C:
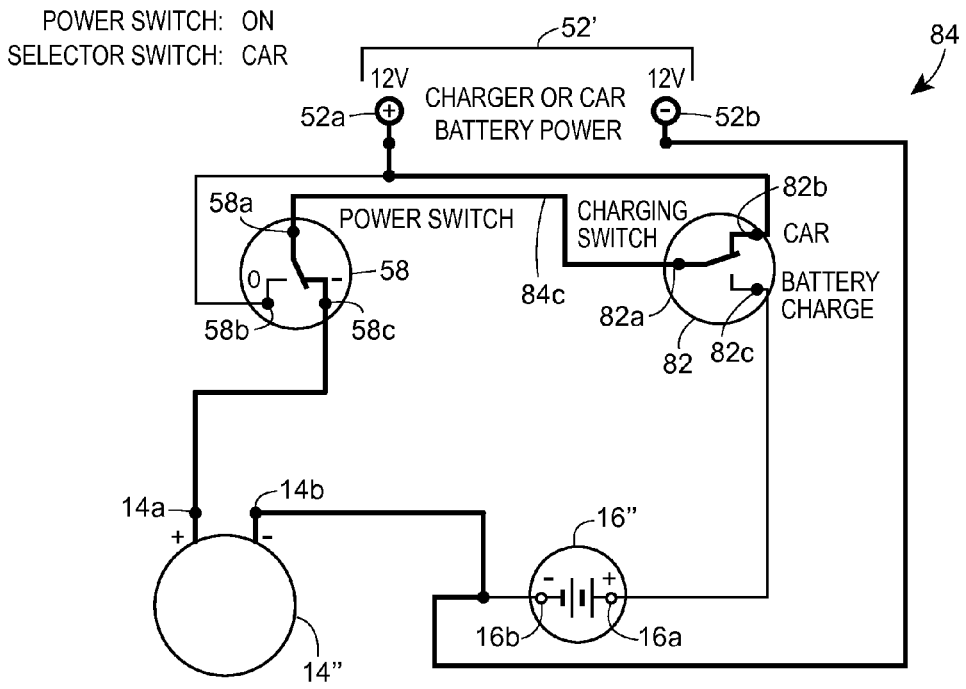

The third current path 84*c* is illustrated in bold in FIG. 7*c*. This occurs when the power switch 58 is in the "on" position and the charge switch 82 is in the "car" position. In this situation, the motor 14 will operate if the 12v DC power adapter 80 is plugged into the DC power input port 52'. However the motor 14" will not operate if the AC/DC charger 44 is plugged into the DC power input port 52', as the output power of the AC/DC charger 44 is current limited and therefore insufficient to power the motor 14".

Figure 7D:
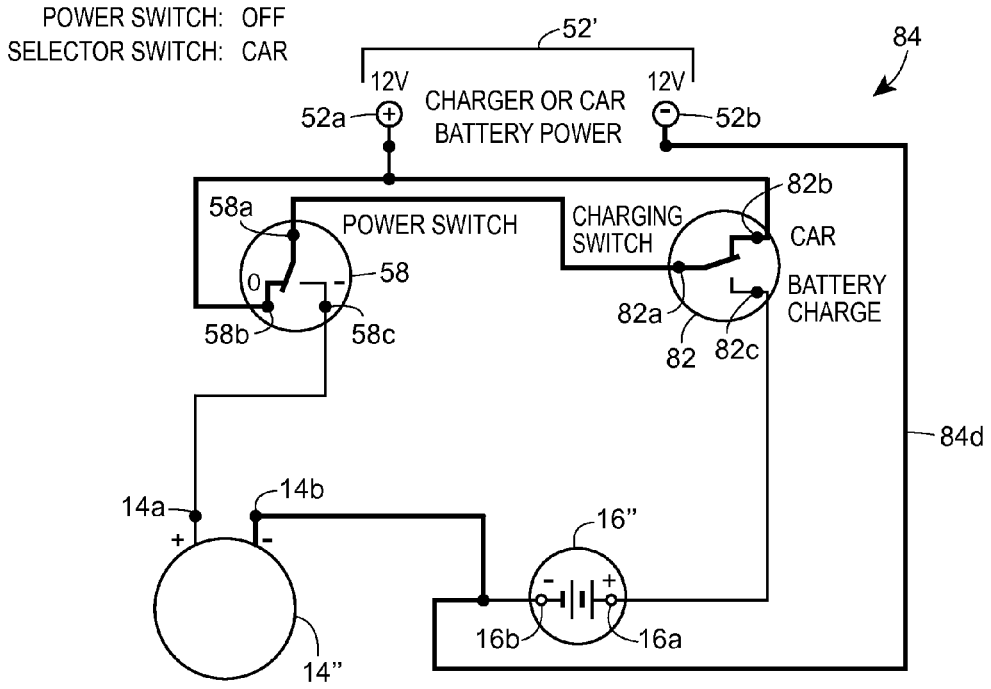

The fourth current path 84*d* is illustrated in bold in FIG. 7*d*. This occurs when the power switch 58 is in the "off" position and the charge switch 82 is in the "car" position. In this situation, the motor 14 will not operate, nor will the battery pack 16" charge, regardless of whether the AC/DC charger 44, or the DC power adapter 80, is plugged into the modified vacuum cleaner 10".

Figure 8:
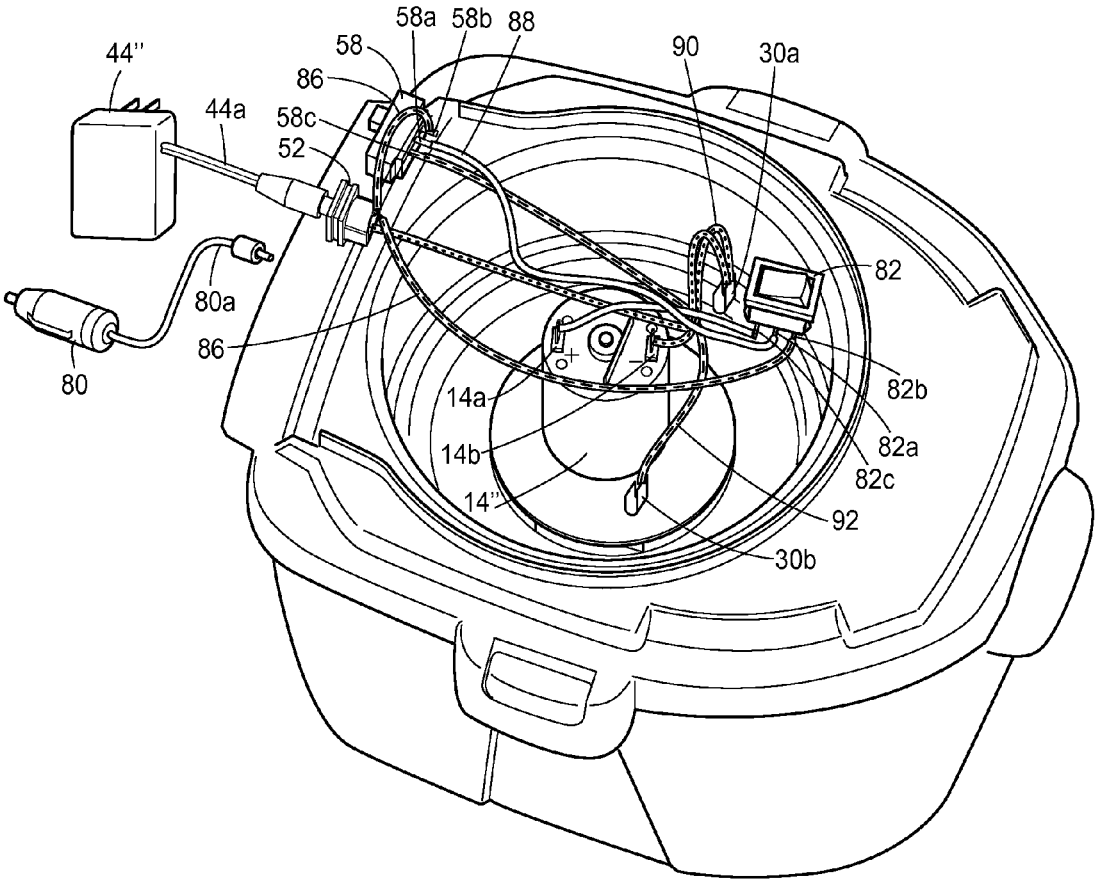
FIG. 8 is a plan view of the modified version of the battery powered vacuum cleaner of FIGS. 4 and 5, illustrating the actually wiring.

One embodiment of particular wiring of the circuit 84 is illustrated in FIG. 8. The wiring includes a first conductor 86 coupling the positive input power terminal to the first power switch terminal 58*b* and to the first charger switch terminal 82*b* and a second conductor 88 coupling the common power switch terminal 58*a* to the common charger switch terminal 82*a*.

The wiring further includes a third conductor 90 coupling the negative input power terminal to the negative battery terminal 16*a* (not shown in FIG. 8), via a connector 30*a* and to the negative motor terminal 14*b* and a fourth conductor 92 coupling the second charge switch terminal 58*c* to the positive battery pack terminal 16*b*. The wiring still further includes a fifth conductor 94 coupling the second power switch terminal 82*c* to the positive motor terminal 14*a*.

While specific embodiments have been illustrated and described, numerous modifications may come to mind without departing from the spirit of the invention. The scope of protection is only intended to be limited by the scope of the accompanying claims.

What is claimed:

1. A portable vacuum cleaner comprising:

a rechargeable battery having a nominal battery voltage output at a first voltage level;

a DC motor operable at a voltage level substantially equal to the first voltage level;

a DC power input port for receiving DC power, the DC power input port adapted to electrically couple the vacuum cleaner alternatively to:

a first a source of DC power at a first voltage output level substantially equal to the first voltage level; and a second source of DC power at a second voltage output level, the second voltage level substantially greater than the first voltage level; and a switch having four output states switchable to selectively cause four operational states, the operational states comprising:

a first operational state wherein the motor will operate as powered by the battery;

a second operational state wherein the motor will not operate, and the battery will not charge if coupled to the first source of DC power and the battery will charge if coupled to the second source of DC power;

a third operational state wherein the motor will operate if coupled to the first source of DC power but will not operate if coupled to the second source of DC power; and a fourth operational state wherein the motor will not operate and the battery will not recharge.

2. The vacuum cleaner of claim 1 wherein the nominal motor voltage is 12v DC.

3. The vacuum cleaner of claim 1 wherein the second source of DC power comprises an AC/DC converter.

4. The vacuum cleaner of claim 3 wherein the AC/DC converter has a current output limited to provide a trickle charge to the battery.

5. The vacuum cleaner of claim 3, wherein the AC/DC converter provides a current output of approximately 300 mA and a voltage output in the range of 14.5-14.8v.

6. A portable vacuum cleaner comprising:

a DC motor operable at a nominal DC voltage , the DC motor having a positive motor terminal and a negative motor terminal;

a rechargeable battery having nominal output voltage substantially equal to the nominal DC voltage of the motor, the battery having a positive battery terminal and a negative battery terminal;

a power switch having a common power switch terminal selectively coupled to a first power switch terminal and a negative power switch terminal;

a charging switch having a common charging switch terminal selectively coupled to a first charging switch terminal and a negative charging switch terminal;

a DC power input port having a positive input terminal and a negative input terminal, the DC power input port adapted to alternatively electrically couple to a DC adapter and an AC/DC converter, the DC adapter adapted to provide a DC voltage substantially equal to the nominal DC voltage of the motor and an AC/DC power converter adapted to provide DC power at a voltage substantially greater than the nominal DC voltage of the motor; and a circuit for selectively coupling the DC power input port to the motor and the battery, the circuit comprising:

a power switch having a common power terminal and first and a second power terminals, the power switch being switchable between a first power position wherein the common power terminal is coupled to the first power terminal and a second power position wherein the common power terminal is coupled to the second power terminal;

a charging switch having a common charging terminal and first and a second charging terminals, the charging switch being switchable between a first charging position wherein the common charging terminal is coupled to the first charging terminal and a second charging position wherein the charging terminal is coupled to the second charging terminal;

a first conductor coupling the positive input power terminal to the first power switch terminal and to the first charger switch terminal;

a second conductor coupling the common power switch terminal to the common charger switch terminal;

a third conductor coupling the negative input power terminal to the negative battery terminal and to the negative motor terminal;

a fourth conductor coupling the second charge switch terminal to the positive battery terminal; and a fifth conductor coupling the second power switch terminal to the positive motor terminal;

wherein a the power switch and the charging switch cooperatively provide four selectable output states, the operational states comprising:

a first operational state wherein the motor will operate as powered by the battery;

a second operational state wherein the motor will not operate, and the battery will not charge if coupled to the first source of DC power and the battery will charge if coupled to the second source of DC power;

a third operational state wherein the motor will operate if coupled to the first source of DC power but will not operate if coupled to the second source of DC power; and a fourth operational state wherein the motor will not operate and the battery will not recharge.

7. The vacuum cleaner of claim 6 wherein the nominal motor voltage is 12v DC.

8. The vacuum cleaner of claim 6 wherein the AC/DC converter has a current output limited to provide a trickle charge to the battery.

9. The vacuum cleaner of claim 8, wherein the AC/DC converter provides a current output of approximately 300 mA and a voltage output in the range of 14.5-14.8v.

10. A portable vacuum cleaner comprising:

a DC motor operable at a first voltage level;

a rechargeable battery having nominal voltage output at the first voltage level;

a DC power input port having a positive input terminal and a negative input terminal, the DC power input port adapted to alternatively receive a first power cable for coupling a source of external DC power substantially at the first voltage level to the DC power input port and a second power cable for coupling a source of external AC power to the DC power input port, the second power cable including an AC/DC converter adapted to convert AC power from the AC power source to DC power at a second voltage level, the second voltage level being greater than the first voltage level; and a circuit coupled to the DC power input port, the battery and the motor, the circuit including a power switch and a charge switch for selectively blocking current flow or directing current flow to operate the motor or recharge the battery, depending upon the relative positions of the power switch and the charge switch and the DC power received at the DC power input port.

11. The vacuum cleaner of claim 10 wherein the AC/DC converter has a current output limited to provide a trickle charge to the battery.

12. The vacuum cleaner of claim 11, wherein the AC/DC converter provides an output of approximately 14.5-14.8v DC and 300 mA.

13. The vacuum cleaner of claim 12 wherein the first voltage level is 12v DC.

14. The vacuum cleaner of claim 10 wherein:

the power switch has a common power terminal and first and a second power terminals, the power switch being switchable between an "off" power position wherein the common power terminal is coupled to the first power terminal and an "on" power position wherein the common power terminal is coupled to the second power terminal;

the charging switch has a common charging terminal and first and a second charging terminals, the charging switch being switchable between a "car" charging position wherein the common charging terminal is coupled to the first charging terminal and a "battery/charge" charging position wherein the common charging terminal is coupled to the second charging terminal;

and the circuit includes:

a first conductor coupling the positive input power terminal to the first power switch terminal and to the first charger switch terminal;

a second conductor coupling the common power switch terminal to the common charger switch terminal;

a third conductor coupling the negative input power terminal to the negative battery terminal and to the negative motor terminal;

a fourth conductor coupling the second charge switch terminal to the positive battery terminal; and a fifth conductor coupling the second power switch terminal to the positive motor terminal.

15. The vacuum cleaner of claim 14, wherein there are four operational states depending upon the position of the power switch and the charge switch, the four operational states comprising:

a first operational state wherein the power switch is in the on position and the charging switch is in the battery/charge position, and the motor will operate as powered by the battery;

a second operational state wherein the power switch is in the off position and the charging switch is in the battery/car position, the motor will not operate, and the battery will not charge if coupled to the first source of DC power and the battery will charge if coupled to the second source of DC power;

a third operational state wherein the power switch is in the on position and the charging switch is in the car position, the motor will operate if coupled to the first source of DC power but will not operate if coupled to the second source of DC power; and a fourth operational state wherein the power switch is in the off position and the charging switch is in the car position the motor will not operate and the battery will not recharge.

* * * * *